United States Patent [19]

Bellocci

[11] 4,448,610

[45] May 15, 1984

[54] CENTRIFUGALLY CAST TUBE OF SPHEROIDAL GRAPHITE CAST-IRON AND ITS METHOD OF MANUFACTURE

[75] Inventor: Rio Bellocci, Pont A Mousson, France

[73] Assignee: Pont-A-Mousson S.A., Nancy, France

[21] Appl. No.: 469,601

[22] Filed: Feb. 24, 1983

[30] Foreign Application Priority Data

Mar. 1, 1982 [FR] France ..... 82 03327

[51] Int. Cl.[3] ..... C21D 5/06; C21D 9/08

[52] U.S. Cl. ..... 148/3; 148/35; 148/139; 148/141; 164/114

[58] Field of Search ..... 148/3, 35, 138, 139, 148/141, 155; 75/123 CB; 164/114

[56] References Cited

U.S. PATENT DOCUMENTS

| | | | |
|---|---|---|---|
| 2,855,336 | 10/1958 | Curry | 148/3 |
| 2,867,555 | 1/1959 | Curry | 148/3 |
| 3,702,269 | 11/1972 | Church | 148/35 |
| 3,860,457 | 1/1975 | Vourinen et al. | 148/35 |
| 3,954,133 | 5/1976 | Miyaoka et al. | 148/138 |
| 4,177,088 | 12/1979 | Pierrel | 148/155 |

FOREIGN PATENT DOCUMENTS

| | | | |
|---|---|---|---|
| 2460510 | 1/1976 | Fed. Rep. of Germany | 164/114 |
| 148237 | 5/1981 | Fed. Rep. of Germany | 148/35 |
| 55-31167 | 3/1980 | Japan | 164/114 |
| 55-128563 | 10/1980 | Japan | 148/35 |
| 56-127747 | 10/1981 | Japan | 148/35 |
| 56-130453 | 10/1981 | Japan | 75/123 CB |

*Primary Examiner*—Peter K. Skiff

*Attorney, Agent, or Firm*—Sughrue, Mion, Zinn, Macpeak and Seas

[57] ABSTRACT

The cast tube (T) is subjected internally in a chill-mould (1) to the uniform spraying of water from 1000° C. approximately to 350° C. approximately. Then it is extracted from the chill-mould and in a furnace is subjected to isothermal bainitisation maintenance, after which it is cooled in the atmosphere to ambient temperature. Without it being necessary to add expensive chilling elements, one thus obtains lightened tubes having very good mechanical properties and the ovalisation of which remains acceptable.

6 Claims, 6 Drawing Figures température °C
1400
1200
1000
800
750
600
400
350
200
0
a
b
c
d
e
f
g
h
j
k
p
10
20
30
40
50
60
70
temps (mn)

température °C
1400
1200
1000
800
600
400
350
200
0
a
b
c
d
e
f
m
n
p
q
10
20
30
40
50
60
70
temps (mn)

CENTRIFUGALLY CAST TUBE OF SPHEROIDAL GRAPHITE CAST-IRON AND ITS METHOD OF MANUFACTURE

BACKGROUND OF THE INVENTION

The present invention relates to the manufacture of tubes from spheroidal graphite cast-iron by centrifugal casting and more particularly to a thermal treatment following the centrifugal casting intended to give the centrifuged tube a structure making it lighter.

After centrifugal casting and thermal treatment, tubes—that is to say cylindrical pipes of constant thickness—made from spheroidal graphite cast-iron at present have a ferritic structure which has two advantages: on the one hand, this structure gives them good mechanical characteristics (elastic resilience and ductility), on the other hand, this ferritic structure is easily obtained by thermal treatment after centrifugal casting, either in a chill-mould provided internally with a thick coating of a pulverulent mixture of silica and bentonite in suspension in water (a so called "wet-spray" coating) or in a chill-mould without such a coating.

In the case of the presence of a "wet-spray" coating on the chill-mould, the tube is extracted from its chill-mould and rapidly introduced into a furnace before it has cooled too much then is subject to a thermal treatment known as "maintaining ferritisation" at a temperature of the order of 750° C., for a period of time of the order of 20 to 25 minutes, then it is left to cool naturally.

If there is no "wet-spray" coating on the chill-mould, the pipe is extracted from its casting mould and is introduced rapidly into a furnace where it is subjected to graphitisation annealing at a temperature of the order of 950° C. for a period of time of the order of 20 to 25 minutes, then to maintaining ferritisation at a temperature of the order of 750° C. for a period of time of the order of 15 to 20 minutes.

The Applicant has previously addressed the problem of obtaining economically cast-iron tubes produced by centrifugal casting, which are lighter than current tubes, without any appreciable loss of mechanical features.

The Applicant has sought to achieve this result by giving the tube of spheroidal graphite cast-iron a bainitic structure, instead of the customary ferritic structure, which bainitic structure has a tensile strength and characteristic of elongation as well as a characteristic of resilience equal to or greater than those of the ferritic structure.

The bainitic structure of the spheroidal cast-iron has already been studied for cast-iron parts cast in a chill-mould, in particular for mechanical parts of motor vehicles, as described for example in French Pat. No. 1 056 330, on account of the good mechanical characteristics conferred by a structure of this type.

In an article of the journal "Hommes et Fonderie" (Men and the Foundry) No. 84 of April 1978, a thermal treatment for obtaining this bainitic structure is described. The thermal treatment described is that of so called "chilling by stages" which makes it possible to lead to the bainitic structure by passing through austenitisation by successive stages of cooling at different speeds, of which one is chilling, starting with the hot part, as it has been cast. This treatment has the advantage of not requiring initial heating for austenitisation.

However, according to the technique described in this article, in view of the low aptitude for chilling of spheroidal graphite cast-iron, not only is it necessary to have very close checking of the carbon, silicon and manganese contents of the cast-iron, but also, if one wishes to treat relatively thick parts, it is necessary to add expensive alloying elements such as molybdenum, which even in small quantities are particularly effective for increasing the aptitude for chilling of cast-iron to a sufficient extent, in order that the chilling by stages prevents the formation of perlite and leads to the formation of bainite.

SUMMARY OF THE INVENTION

The Applicant has thus tackled the problem of obtaining centrifugally cast tubes of bainitic cast-iron containing spheroidal graphite without the addition of special substances, which are expensive even in small quantities, such as molybdenum.

To this end, the invention relates to a centrifugally cast tube of spheroidal graphite cast-iron, characterised in that the cast-iron has the following composition by weight:

carbon: 2.5–4.0%
silicon: 2–4.0%
manganese: 0.1–0.6%
nickel: 0–3.5%
copper: 0–11%
magnesium: 0–0.5%
sulphur: 0.01% maximum
phosphorus: 0.06% maximum
the remainder being iron,
this cast-iron having a bainitic structure.

In order to produce a tube of this type, according to the invention, one begins with a spheroidal graphite cast-iron having the above mentioned composition, this cast-iron is cast in a centrifugal chill-mould provided with a refractory lining and cooled externally by water, the centrifugally cast tube is left to cool in the chill-mould to a temperature of the order of 800°–1000° C. in order to acquire an austenitic structure, then, still in the chill-mould, it is cooled vigorously and uniformly over its entire length by spraying water or a mixture of air and water onto its inner wall, to a temperature of approximately 250°–400° C., in order to give it an austenitic or bainitic structure, then the tube is removed from the chill-mould and placed inside a furnace kept at a temperature of between 250° and 450° C. for the purpose of creating or maintaining a bainitic structure and the tube is removed from the furnace in order to allow it to cool in the air.

Experience shows that the tube according to the invention has a substantially reduced unit weight and a substantially increased working pressure, at the cost of higher ovalisation under the actual weight of the tube, but which remains within acceptable limits.

BRIEF DESCRIPTION OF THE DRAWINGS

The invention is described hereafter in more detail with reference to the accompanying drawings, which show only one embodiment thereof. In these drawings.

DETAILED DESCRIPTION OF THE PREFERRED EMBODIMENTS

Figure 1:
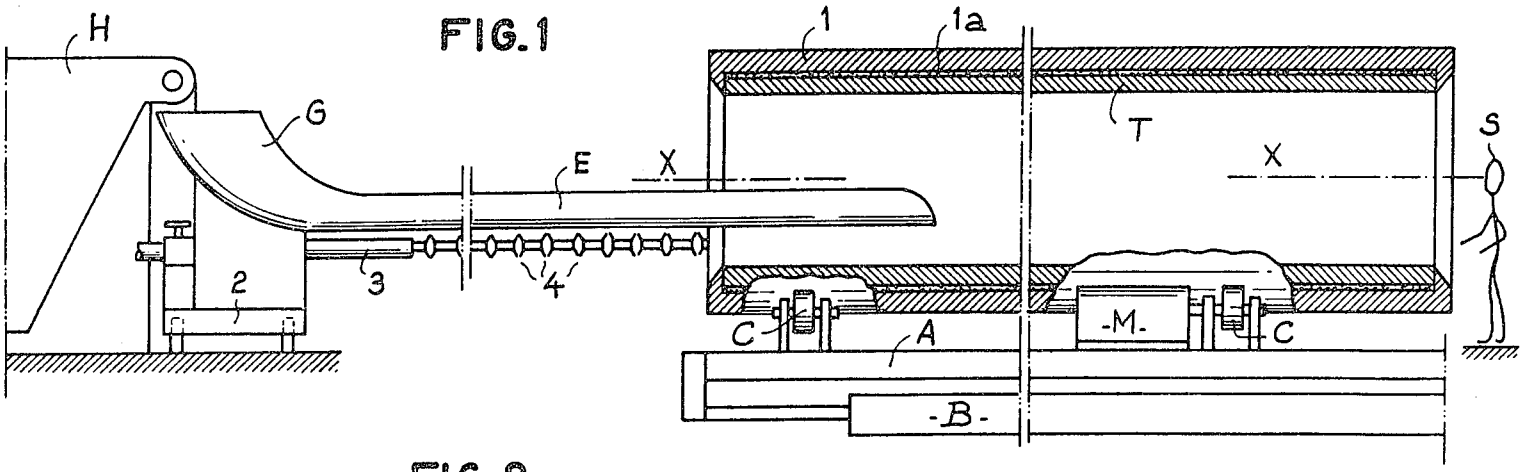
FIG. 1 is a partial diagrammatic view in longitudinal section of a machine for the centrifugal casting of cast-iron tubes, equipped with a spray device for carrying out the method according to the invention, the machine being in the position at the end of casting.
Figure 3:
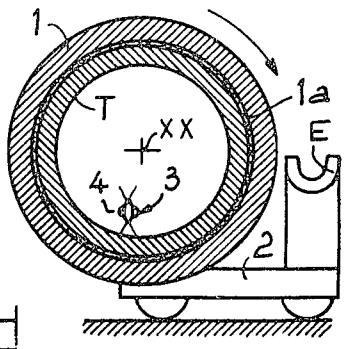
FIG. 3 is a cross-sectional view on line 3—3 of FIG. 2.
Figure 2:
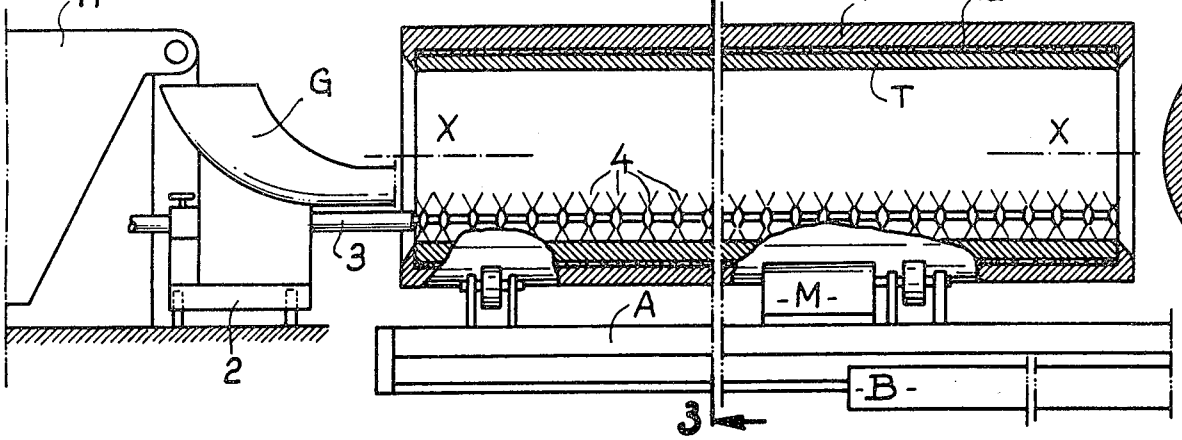
FIG. 2 is a view similar to FIG. 1 of the machine during the stage of spraying the tube in the chill-mould of the method according to the invention.

According to the embodiment of FIGS. 1 to 3, the invention is applied to the manufacture of tubes from spheroidal graphite cast-iron by centrifugal casting.

The mehod according to the invention consists of starting with a composition of spheroidal graphite cast-iron which is as follows, with percentages by weight:

carbon: 2.5–4.0% and in particular 3.6%
silicon: 2–4.0% and in particular 2.4%
manganese: 0.1–0.6% and in particular 0.5%
nickel: 0–3.5% and in particular 0.2%
copper: 0–1.1% and in particular 0.5%
magnesium: 0–0.5% and in particular 0.03%
sulphur: 0.01% maximum
phosphorus: 0.06% maximum
the remainder being iron.

This composition of cast-iron has been modified with respect to that which normally serves for the manufacture of pipes from spheroidal graphite cast-iron with a ferrito-perlitic structure due to the addition of the elements Ni and Cu, which were not present and preferably by the addition of an appreciable amount of Mn, basic cast-iron normally containing only 0.1–0.2%. The elements Ni, Cu, Mn have the property of improving the capacity of the cast-iron for chilling.

This composition of spheroidal graphite cast-iron is cast by centrifugation in a centrifugal casting machine illustrated diagrammatically in FIGS. 1 to 3.

This machine essentially comprises a carriage A which is able to move longitudinally by virtue of a jack B. This carriage A supports a metal centrifugal casting chill-mould 1, on an approximately horizontal axis X—X, through the intermediary of rollers C whereof at least one is driven by a motor M. The chill-mould 1 provides a cylindrical casting cavity of the same diameter from one end to the other, with a view to obtaining a tube T of constant diameter and wall thickness over its entire length, thus without any socket. For example, the tube T has a length of six to eight meters for an inner diameter which may range from 60 mm to 2000 mm depending on the centrifugal casting machine and the chill-mould 1 used.

As is known, the machine is provided with a device for the external cooling of the chill-mould 1. The latter may be ramps for spraying water, distributed around the chill-mould 1, inside a casing or bodywork enclosing this chill-mould, or even a jacket with water circulating from one end of the chill-mould to the other and outside the latter, in a closed circuit. For the purpose of simplification, the device for cooling the outside of the chill-mould 1, whatever this device and since it is known per se, has not been illustrated.

Moreover, in view of the fact that the invention applies preferably, but not exclusively, to the manufacture of large diameter cast-iron tubes, i.e. diameters greater than 700 mm and which may even reach 2000 mm, a human silhouette S has been shown beside the machine, on the right in FIG. 1, in order to illustrate the considerable diameter of the chill-mould 1 in which the tube T is to be cast.

Although, for reasons given hereafter, it is for large diameters that the method of the invention is most advantageous, this method can also be applied to the manufacture of cast-iron tubes of small and average diameters, i.e. of diameters comprised between approximately 50 and 600 mm.

A runner E provided upstream of a chute G supplied with molten cast-iron by a tilting ladle H is able to penetrate inside the chill-mould 1, roughly parallel to its axis X—X.

The arrangement of the runner E and of its chute G is mounted to overhang on a carriage 2 able to move transversely with respect to the axis X—X, i.e. in an end direction with respect to the plane of FIG. 1. The transverse carriage 2 also supports in an overhanging manner a long rigid conduit or ramp 3 for spraying water, which is connected to a supply of pressurized water (not shown). The rigid conduit 3 has a length corresponding to that of the runner E, thus of the chill-mould 1 and is also approximately parallel to the axis X—X of the chill-mould 1. It is mounted on the transverse carriage 2 staggered with respect to the runner E by a transverse distance such that due to a transverse movement of the carriage 2, when the runner E is inside the chill-mould 1, the rigid conduit 3 is outside and vice versa.

The rigid conduit or ramp 3 is provided over its entire length with pairs of twin nozzles 4 for spraying water. The jets of the nozzles 4, which are arranged opposite each other in pairs, have adjustable sections and are regulated in order that each provides a suitable flow of water depending on the thickness of the tube, which is substantially constant over the entire length of the tube T. The means for regulating the sections of the jets from the nozzles 4, which are known per se, are not shown.

Before each casting operation, the chill-mould 1 is provided with a refractory coating $1^a$, the so called "wet-spray" coating, i.e. a mixture of silica powder and bentonite in suspension in water. For example, this coating has a thickness of between 0.05 and 0.8 mm. The constituents of this coating mixture are in the following proportions: 500–3000 grams of silica powder having a grain size of between 40 and 100 microns and 10–40 grams of bentonite per liter of water. The members for spraying this coating, which are known per se, have not been shown.

It should be noted that in FIG. 1, in which the runner E is partly located inside the chill-mould 1, part of the conduit 3 comprising nozzles 4 is not visible, since this conduit is retracted laterally. It is necessary to consider FIG. 2 in order to see the conduit 3 with all its nozzles 4 introduced inside the chill-mould 1 in the spraying position. The runner E is thus in a position retracted laterally, in front of the plane of FIG. 2 and has been shown only partly, for the sake of clarity of the drawing. This is clear in FIG. 3.

By means of this installation, one proceeds with the casting of a tube T by centrifugation, by introducing into the chill-mould the runner E, then by pouring cast-iron through this runner whilst extracting it progressively from the chill-mould. According to the invention, one pours into the centrifugal casting chill-mould 1 only a quantity of cast-iron which is able to produce a centrifuged tube whereof the thickness is much less than the customary thickness, taking into account the diameter (see hereafter the table of numerical values).

When the casting of the tube T is completed, the latter is subjected to the following thermal treatment, which consists of chilling in stages carried out partly inside the centrifugal chill-mould 1 and partly in a maintaining furnace, with a view to obtaining and maintaining a bainitic structure, thus preventing the formation of perlite.

In a first stage of this thermal treatment (FIGS. 5 and 6, curve drawn in full line) the tube T is left inside the centrifugal chill-mould 1 in order to subject it to bainitisation chilling, passing through austenitisation, without heating, thus benefiting from the heat of casting. One thus obtains a tube which has been centrifuged and has solidified and is still at a temperature of the order of 1150° C. (after passing from the point a to the point b on the curve drawn in full line in FIGS. 5 and 6).

Owing to the fact that the chill-mould 1 is cooled externally and that the tube T is allowed to rotate about itself, the latter cools slowly from a to b and from b to c, i.e. from 1300° C. to 1150° C. and from 1150° C. to 1000° C. in a virtually homogeneous manner. In the vicinity of the point c of the curve drawn in full line in FIGS. 5 and 6 and even below this point, for example to 800° C., one notes a slight temperature difference between the inner wall and the outer wall, less than 20° C., it is this tube T with a homogeneous temperature which is thus austenitised, i.e. with an austenitic structure at the point c, without the application of heat, but by cooling which occurs after casting inside the chill-mould 1.

From this homogeneous state as regards temperature and austenitic structure, the thermal treatment of chilling or rapid cooling is carried out inside the centrifugal chill-mould by means of the spray ramp 3 and the spray nozzles 4, by spraying water or a mixture of air and water.

To this end, immediately after casting, the runner is retracted laterally due to a movement of the carriage 2, the spray ramp 3 comprising nozzles 4 is introduced completely into the centrifugal chill-mould 1 and one proceeds with spraying of the cavity of the tube T which has just been cast, whilst continuing to rotate the chill-mould 1. Naturally, the spray rate, which is theoretically constant over the entire length of the centrifuged tube, may be adjusted locally, if local irregularities in temperature of the chill-mould 1 are ascertained, although one seeks to keep the external cooling of the latter constant and uniform.

By proceeding in this way, the tube T is cooled homogeneously. This stage of chilling is represented by the section c–d in the curves drawn in full line in FIGS. 5 and 6. The temperature of the tube T thus drops in several minutes from approximately 1000° C. (or less, for example 800° C.) to approximately 350° C.

The water sprayed is vaporized inside the rotating pipe and discharged in a suitable manner by means which are not illustrated.

Figure 5:
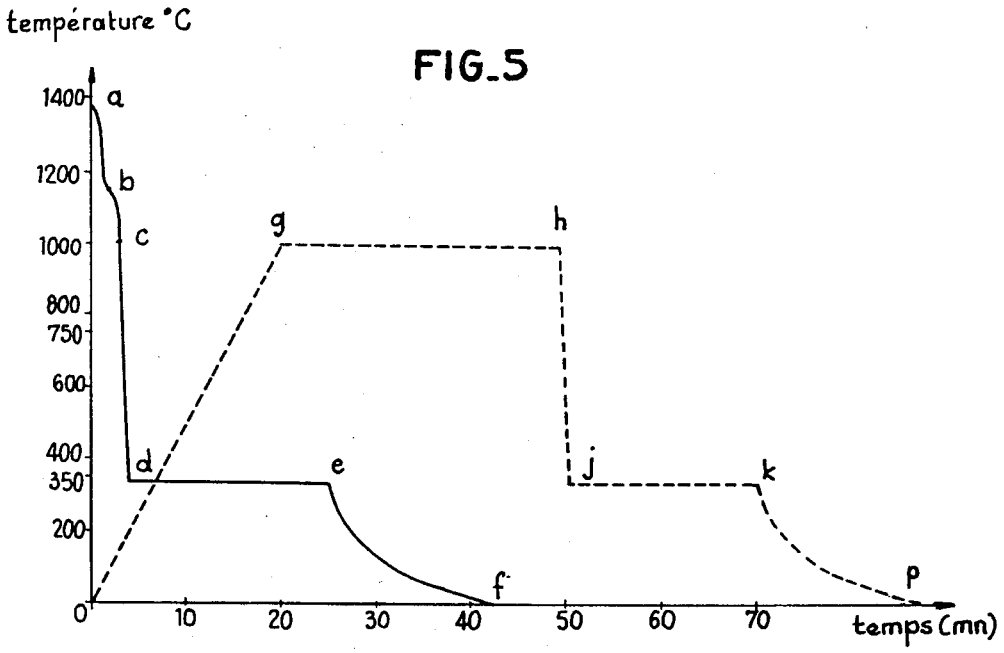
FIGS. 5 and 6 are comparative diagrams of the thermal treatment of the method of the invention (curves drawn in full line) with respect to known prior thermal treatments, respectively for obtaining a bainitic structure with austenitisation heating and for obtaining a ferritic structure in the conventional manufacture of centrifugally produced cast-iron tubes, these curves corresponding to tubes having a nominal diameter of 1600 mm.
Figure 6:
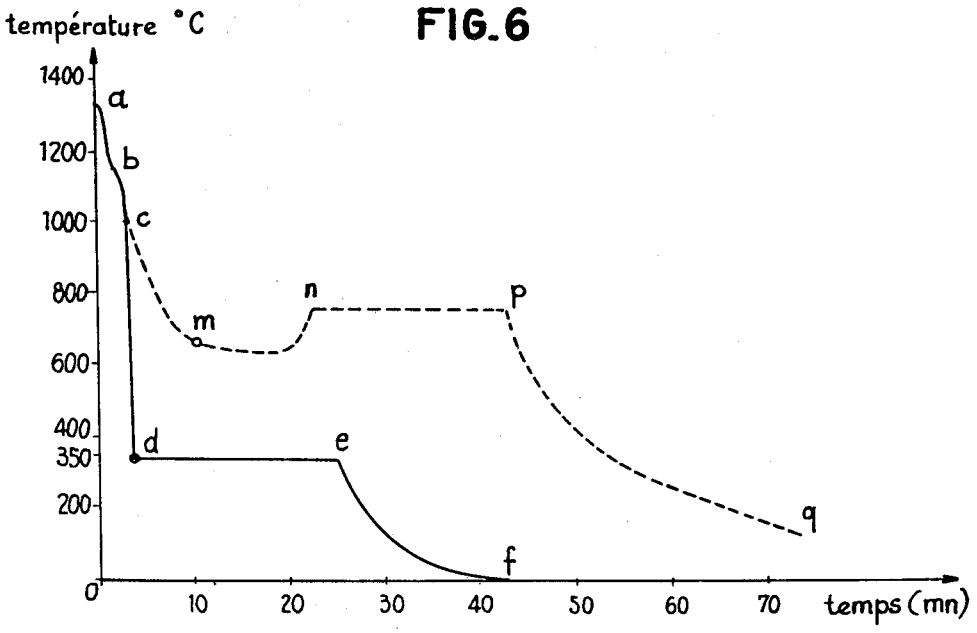

In fact, the temperature at the end of chilling is between 250° C. and 450° C. In this temperature range which is located either slightly above or slightly below the value of 350° C. marked on the curves of FIGS. 5 and 6, the tube T has sufficient rigidity so that there is no longer any danger of ovalisation outside the centrifugal chill-mould. Owing to the chilling c–d, the tube has also obtained a structure which is free from perlite. In the curves of FIGS. 5 and 6, the region corresponding to perlite is situated on the right of this curve, at a certain distance from the portion c–d.

Figure 4:
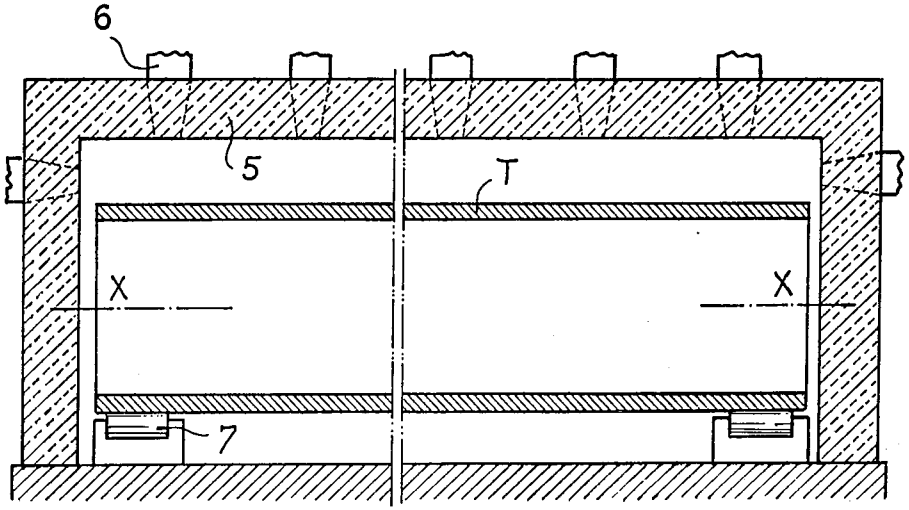
FIG. 4 is a diagrammatic cross-sectional view showing the stage of maintaining bainitisation, inside a furnace, of the method of the invention.

The second stage of thermal treatment consists of maintaining the temperature in order to consolidate or fix the bainitic structure (maintaining bainitisation). For this, subsequent to the preceding stage of rapid cooling or chilling, the tube T is extracted from the centrifugal chill-mould, either by stopping the rotation of the latter, or by continuing to rotate it during the extraction, depending on the extractor device available. As shown in FIG. 4, the tube T removed from the mould is introduced into a tunnel furnace 5 comprising heating nozzles 6, of known type, regulated in order to keep the pipe at a constant temperature of between 250° and 450° C., for example at 350° C., for 5 to 120 minutes (portion d–e of the chilling curve of FIGS. 5 and 6), this maintaining time being approximately the same for all diameters of tubes, to within 10 minutes.

The time for maintaining the temperature is intended to obtain a homogeneous bainitic structure producing the optimum mechanical characteristics mentioned hereafter.

The tube T is supported in the furnace 5 by a conveyor chain 7, which may be of a type simultaneously ensuring the rotation of the tube about its own axis.

The last stage of the thermal treatment consists of rapid cooling in the atmosphere: upon the expiry of the period of maintaining bainitisation, the tube T is removed from the maintaining furnace 5 and left to cool in the atmosphere according to the portion e–f of the curves drawn in full line in FIGS. 5 and 6, which produces rapid cooling, in approximately 12 minutes, virtually down to ambient temperature. Chilling of the tube in stages is represented by the portions c–d–e–f of the cooling curve drawn in full line.

FIGS. 5 and 6 illustrate the advantages of the thermal treatment according to the invention, illustrated by the curves drawn in full line, with respect to previous known treatments, represented by the curves drawn in broken line. It can be seen that a considerable saving of time is achieved, but this is not the only advantage.

As shown by the curve drawn in broken line in FIG. 5, the conventional treatment for obtaining a bainitic structure of a part cast in a static manner (which is thus not a centrifugally cast tube) comprises a portion h–j–k–l similar to the portion c–d–e–f of the method of the invention, but staggered in time by approximately 1 to 2 hours owing to the two previous stages 0-g for austenitisation heating, which may last from 20 minutes to 2 hours depending on the applications and g–h for maintaining austenitisation at a temperature of approximately 1000° C., more generally between 800° and 1000° C. The previous known treatment thus requires the application of heat in order to bring the treated parts to the austenitisation temperature instead of treating the parts in the mould, immediately after their casting. It is thus clear that the method of the invention, by economising on heating for austenitisation, provides a considerable saving of energy with respect to a treatment of this type.

In FIG. 6, the thermal treatment of the invention is compared with the previous technique of thermal ferritisation treatment (annealing). The previous thermal treatment (curve drawn in broken line) has the portion a–b–c in common with the curve of the invention drawn in full line. Then, the remainder of the curve c–m–n–p–q is substantially different from the curve c–d–e–f of the method of the invention. In the process of ferritisation, the tube is left inside its centrifugal chill-mould according to the curve a–b–c–m: this corresponds to cooling at a moderate speed, owing to the external cooling of the centrifugal chill-mould and of the natural internal cooling of the centrifuged tube. The austenitic structure forms from a to c. Beyond c, this structure is not maintained, but cooling continues up to m, at which point one proceeds with the extraction from the chill-mould of the tube which has cooled sufficiently to prevent substantial ovalisation. This is followed by somewhat slower cooling in air until the tube is introduced into an annealing furnace for ferritisation at a temperature of the order of 750° C. As can be seen, the application of heat is necessary, inside the annealing furnace, in order to obtain the ferritic structure, according to the ascending part m–n of the curve, as well as for maintaining the temperature according to the portion n–p. This application of heat is substantially greater than that which is necessary for maintaining bainitisation according to the portion d–e of the curve drawn in full line, in the maintaining furnace 5 and this is all the more since the temperature for maintaining bainitisation is much lower (approximately 350° C.) than the temperature for maintaining ferritisation (approximately 750° C.). In particular, it will be noted that the temperature for maintaining bainitisation is sufficiently low for the extraction of the tube at this temperature to cause no problems and it is not necessary to re-heat this tube at the time of its introduction into the furnace 5. Consequently, with respect to the prior art for the thermal treatment of ferritisation for centrifuged cast-iron tubes, the method of the invention also allows an appreciable saving of energy.

On account of the rotation of the tube whilst it is still inside the centrifugal chill-mould, i.e. during the stages of thermal treatment represented by the portions a–b–c–d of the curves drawn in full line in FIGS. 5 and 6, thus during natural cooling and during chilling by spraying, cooling of the pipe is homogeneous.

The bainitic structure makes it possible to reduce the wall thickness and thus the unit weight of the tubes on account of its good mechanical properties. This substantial reduction of thickness is also advantageous as regards the homogeneity of cooling during the stages a–b–c–d and in particular for the aptitude for chilling: it ensures the efficiency of this chilling according to the stage c–d of the thermal treatment curve, throughout the entire thickness of the centrifugally cast tube, without it being necessary to add to the composition of the cast-iron, expensive metal elements having a chilling effect, i.e. facilitating chilling, such as molybdenum. In other words, the substantial reduction in thickness of centrifuged cast-iron tubes provides an appreciable saving as regards the composition of the cast-iron.

It has also been shown that the austenitisation and bainitisation treatment according to stages b–c–d of the thermal treatment curve of the tube T inside the centrifugal chill-mould prevents any deformation of the tube, thus any ovalisation whilst it is at a high temperature. In fact, the centrifugal chill-mould, serving as a support for the tube, preserves its perfectly cylindrical shape and this is despite the appreciable reduction of thickness which increases its tendency towards ovalisation. This tendency towards ovalisation would cause serious problems if the tube were extracted from the centrifugal chill-mould at a higher temperature, for example above 500° C.

Carrying out the thermal treatment according to the invention and more particularly the stage of spraying or atomizing water inside the cavity of the tube according to the portion c–d is particularly simple and economical with respect to a conventional hardening treatment in a bath of salt, which would also necessitate transportation of the tube from its chill-mould whilst it is still hot and handling to immerse the tube in a bath of salt. The method of the invention makes it possible to save on this handling and at the same time to prevent the danger of ovalisation which it involves.

The appreciable saving of time mentioned above makes it possible to increase the rates of manufacture of centrifugally cast tubes from spheroidal graphite cast-iron having a bainitic structure. Spraying the inside of the centrifugally cast pipe during the chilling stage reduces the residence time of the centrifugally cast tube in the centrifugal chill-mould. This is shown by comparing the two curves of FIG. 6, in which the extraction of the tube from the chill-mould is located at the point m in the prior art whereas it is located at the point d, 5 to 10 minutes previously, in the method of the invention.

For the centrifugal chill-mould this advantageously results in an appreciable reduction in the thermal stresses, since the heat to be discharged is approximately 30 to 40% less with respect to the prior art for the manufacture of tubes from cast-iron having a ferritic structure, owing to the discharge of heat through the spray water and the reduction in the quantity of cast-iron poured inside the chill-mould. Consequently, the life expectancy of the centrifugal chill-moulds, which are the largest and most expensive parts of the centrifugal casting equipment, should be extended considerably with respect to the prior art.

Finally, the tube of the invention cast centrifugally from spheroidal graphite cast-iron having a bainitic structure, despite its substantial reduction of thickness, which causes lightening facilitating its handling, preserves mechanical characteristics substantially equivalent to those of previous ferritic tubes at the cost of greater sensitivity to ovalisation, however this sensitivity remaining tolerable owing to the fact that the tube is not handled when it is at the high temperature prone to ovalisation.

As regards the mechanical characteristics of the tube according to the invention, the following table gives numerical examples of dimensions, weights, guaranteed working pressure and ovalisation for tubes intended to be buried at a depth of 4 meters and for large diameter pipes, i.e. greater than 700 mm nominal diameter. The values relating to the bainitic tube of the invention are compared with those of the prior art relating to a ferritic tube and a lightened ferritic tube. In this table, the coefficient K, defined by the international standard ISO 2531, characteristics the thickness of the tube according to the formula: $e=K\ (0.5+0.001\ D.N.)$ in which:

e=thickness of the tube wall in mm

DN=nominal diameter.

| Large Diameter Tubes Depth of covering provided = 4 meters | | | | | | | | | | | | |
|---|---|---|---|---|---|---|---|---|---|---|---|---|
| | Prior art ferritic and perlitic tube (K = 9) | | | | Prior art lightened ferritic tube (with coating)* | | | | Invention Bainitic Tube lightened, coated* | | | |
| Nominal Diameter | wall thickness mm | mean weight kg/m | Working pressure $P_S$ bars | Ovalisation under own weight (%) | wall thickness mm | mean weight kg/m | $P_S$ bars | Ovalisation under own weight (%) | wall thickness mm | mean weight kg/m | Working pressure $P_S$ bars | Ovalisation under own weight (%) |
| 800 | 11.5 | 211 | 28.5 | 0.09 | 8 | 147.8 | 23 | 0.22 | 5.9 | 109.3 | 29 | 0.56 |
| 1000 | 13.2 | 303 | 28 | 0.13 | 9.7 | 223.1 | 23.2 | 0.28 | 6.8 | 156.8 | 28.7 | 0.74 |
| 1200 | 15.0 | 412 | 27.5 | | 11.3 | 311.3 | 23 | | 7.9 | 218.2 | 28.5 | 0.90 |
| 1400 | 16.8 | 536 | 27.3 | | 13.0 | 417.2 | 23.2 | | 9.0 | 189.6 | 28.5 | 1.05 |
| 1600 | 18.5 | 677 | 26.9 | | 14.5 | 531 | 23 | | 10.0 | 367.2 | 28.4 | 1.21 |
| 1800 | 20.3 | 833 | 26.5 | 0.30 | 16.2 | 666.6 | 23 | 0.51 | 11.1 | 458 | 28.3 | 1.36 |
| 2000 | 22.1 | 1006 | 26.3 | 0.34 | 17.8 | 813 | 23 | 0.56 | 12.3 | 503.3 | 28 | 1.47 |

*in general, centrifugal inner coating of cement mortar and outer coating of black varnish.

The above table shows that the saving of unit weight which the invention makes it possible to obtain is much greater the greater the diameter of the tube.

By way of comparison and to the advantage of the tube having a bainitic structure of the invention, the mechanical characteristics obtained are as follows:

elastic limit 55 to 75 daN/mm$^2$ (instead of approximately 30 for the ferritic structure)

elongation greater than 10% (like the ferritic tube);

breaking strength 70 to 110 daN/mm$^2$ (ferritic tube 45 daN/mm$^2$ approximately).

Figure 7:
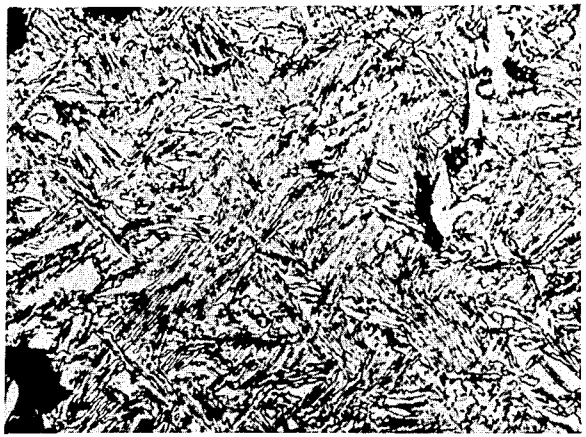

FIG. 7 shows a bainitic micrographic structure. In this structure, the black areas which can be seen in the upper and lower left-hand corners are parts of graphite nodules. The elongated forms resembling ferns are ferrite areas. It can be seen that they cover the major part of the surface of the micrograph. The largest white areas correspond to residual austenite. It will be seen that they cover only a small portion of the surface of the micrograph. It is the whole of this structure, recognizable solely with an enlargement of 1000 and not with an enlargement of 100, which is termed "bainitic".

Figure 8:
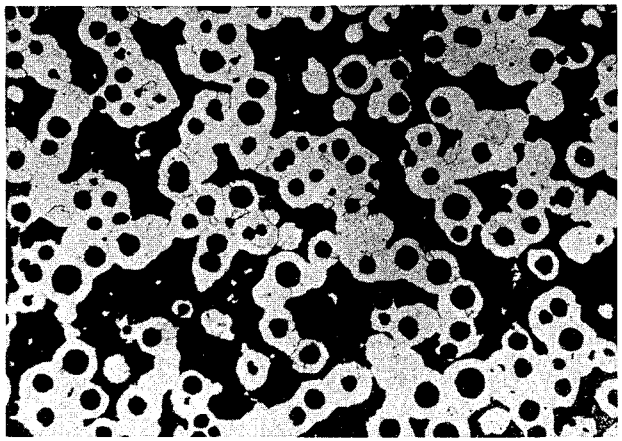
FIGS. 7 and 8 are micrographs of a wall structure of tubes centrifugally cast from spheroidal graphite cast-iron, respectively with a bainitic structure enlarged 1000 times and with a ferritoperlitic structure enlarged 100 times.

By way of comparison, according to the micrograph of FIG. 8, with an enlargement of 100, when attacked with NITAL, this is a ferrito-perlitic spheroidal graphite cast-iron, containing 40% ferrite and 50% perlite, the remainder being spheroidal graphite. The round black areas are graphite nodules. The nodules are surrounded by white areas constituting the ferrite. The remaining grey areas are perlite. This is the structure of a centrifugally cast tube of conventional type.

I claim:

1. Centrifugally cast tube of spheroidal graphite cast-iron, characterised in that the cast-iron has the following composition by weight:

carbon: 2.5–4.0%
silicon: 2–4.0%
manganese: 0.1–0.6%
nickel: 0–3.5%
copper: 0–11%
magnesium: 0–0.5%
sulphur: 0.01% maximum
phosphorus: 0.06% maximum
the remainder being iron, this cast iron having a bainitic structure.

2. Tube according to claim 1, characterised in that the cast-iron has the following composition:

carbon: 3.6%
silicon: 2.4%
manganese: 0.5%
nickel: 0.2%
copper: 0.5%
magnesium: 0.03%
sulphur: ≦0.01%
phosphorus: ≦0.06%,
the remainder being iron.

3. Tube according to claims 1 or 2, characterised in that it corresponds to the following table:

| Nominal Diameter mm | 800 | 1000 | 1200 | 1400 | 1600 | 1800 | 2000 |
|---|---|---|---|---|---|---|---|
| approximate nominal wall thickness (mm) | 6 | 7 | 8 | 9 | 10 | 11 | 12.5 |

4. Method for the manufacture of a centrifugally cast tube of spheroidal graphite cast-iron, the cast-iron having a bainitic structure and a composition by weight of carbon: 2.5–4.0%, silicon: 2–4.0%, manganese: 0.1–0.6%, nickel: 0–3.5%, copper: 0–11%, magnesium: 0–0.5%, sulphur: 0.01% maximum, and phosphorus: 0.06% maximum, the remainder being iron, characterised in that one starts with a spheroidal graphite cast-iron having said composition, this cast-iron is poured into a centrifugal chill-mould provided with a refractory coating and cooled externally by water, the centrifugally cast tube is left to cool in the chill-mould to a temperature of the order of 800°–1000° C. in order to acquire an austenitic structure, then, still in the chill-mould, it is cooled vigorously and uniformly over its entire length by spraying water or a mixture of air and water onto its inner wall, to a temperature of approximately 250°–400° C., in order to give it an austenitic or bainitic structure, then the tube is removed from its chill-mould and placed inside a furnace kept at a temperature of between 250° and 450° C. in order to create or maintain a bainitic structure and the tube is removed from the furnace in order to allow it to cool in the air.

5. Method according to claim 4, characterised in that an aqueous mixture of silica and bentonite is used as the refractory coating for the centrifugal chill-mould.

6. Method according to claims 4 or 5, characterised in that during the first stage of cooling to a temperature of approximately 800° to 1000° C. and during the stage of vigorous cooling by spraying water onto the inner wall of the tube from 800°–1000° C. to 250°–400° C., the tube is set in rotation by means of the centrifugal chill-mould.

* * * * *